US008453761B2

(12) United States Patent
Wiercigroch

(10) Patent No.: US 8,453,761 B2
(45) Date of Patent: Jun. 4, 2013

(54) RESONANCE ENHANCED DRILLING: METHOD AND APPARATUS

(71) Applicant: University Court of the University of Aberdeen, Aberdeen (GB)

(72) Inventor: Marian Wiercigroch, Aberdeen (GB)

(73) Assignee: University Court of the University of Aberdeen, Aberdeen (GB)

( * ) Notice: Subject to any disclaimer, the term of this patent is extended or adjusted under 35 U.S.C. 154(b) by 0 days.

(21) Appl. No.: 13/715,052

(22) Filed: Dec. 14, 2012

(65) Prior Publication Data

US 2013/0105223 A1 May 2, 2013

Related U.S. Application Data

(63) Continuation of application No. 12/303,728, filed as application No. PCT/GB2007/002140 on Jun. 11, 2007, now Pat. No. 8,353,368.

(30) Foreign Application Priority Data

Jun. 9, 2006 (GB) ..... 0611559.6
Apr. 26, 2007 (GB) ..... 0708193.8

(51) Int. Cl.
*E21B 7/00* (2006.01)

(52) U.S. Cl.
USPC ..... 175/56; 175/327

(58) Field of Classification Search
USPC ..... 175/55, 56, 50, 327; 173/91, 73
See application file for complete search history.

(56) References Cited

U.S. PATENT DOCUMENTS

| | | | | | |
|---|---|---|---|---|---|
| 3,768,576 | A * | 10/1973 | Martini | ..... | 173/73 |
| 3,990,522 | A * | 11/1976 | Pyles et al. | ..... | 173/78 |
| 4,615,400 | A * | 10/1986 | Bodine | ..... | 175/55 |
| 5,549,170 | A * | 8/1996 | Barrow | ..... | 175/55 |
| 6,047,778 | A * | 4/2000 | Coffman et al. | ..... | 173/91 |
| 7,591,327 | B2 * | 9/2009 | Hall et al. | ..... | 175/56 |
| 8,353,368 | B2 * | 1/2013 | Wiercigroch | ..... | 175/56 |
| 2007/0221408 | A1 * | 9/2007 | Hall et al. | ..... | 175/57 |
| 2010/0319994 | A1 * | 12/2010 | Wiercigroch | ..... | 175/56 |
| 2011/0056750 | A1 * | 3/2011 | Lucon | ..... | 175/56 |

* cited by examiner

*Primary Examiner* — Daniel P Stephenson
(74) *Attorney, Agent, or Firm* — Fay Sharpe LLP

(57) ABSTRACT

The present invention relates to drilling apparatus comprising a drill-bit (1) capable of rotary and high frequency oscillatory loading; and control means for controlling applied rotational and/or oscillatory loading of the drill-bit, the control means having adjustment means for varying the applied rotational and/or oscillatory loading, said adjustment means being responsive to conditions of the material through which the drill is passing. The control means is in use provided on the apparatus in a downhole location and includes sensors for taking downhole measurements of material characteristics, whereby the apparatus is operable downhole under closed loop real-time control. The apparatus can determine appropriate loading parameters for the drill-bit in order to achieve and maintain resonance between the drill-bit and the drilled material in contact therewith.

13 Claims, 2 Drawing Sheets

RESONANCE ENHANCED DRILLING: METHOD AND APPARATUS

Figure 1:
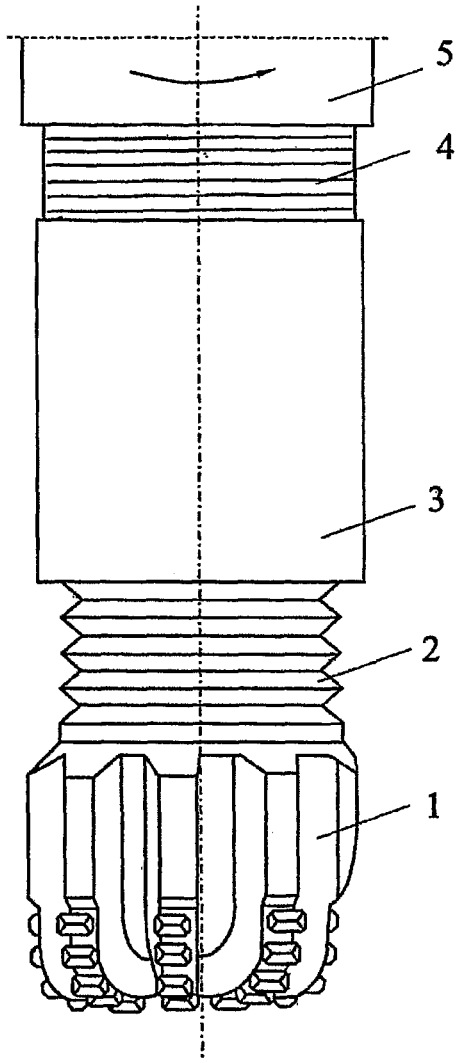

The present invention concerns a drilling device, and in particular a drilling device for drilling into material such as a rock formation.

The field of drilling into rock and other materials has driven a number developments in drilling technology. In this regard, the extremely harsh conditions involved in this type of drilling as well as its cost and the related environmental issues, all put severe demands on the effectiveness, reliability and safety of drilling methods.

As a consequence, industries which employ downhole drilling, such as the oil industry, are keen to develop drilling devices and methodologies that meet these demands and increase drilling rates and decrease tool wear.

In this connection, the oil industry is increasingly having to drill deviated or horizontal long-reach wells in pursuit of new oil reserves. However, such drilling further compounds several issues that challenge present drilling technology such as demands of low weight-on-bit, reduced power availability, variability of rock conditions over the length of the well, danger of bore collapses/fractures, increased costs of tripping, and increased tool wear and failure.

It is known that drilling rates in certain circumstances can be improved by applying reciprocal axial movements to a drill-bit as it passes through the material to be drilled, so-called percussive drilling. This is because the impact of these axial movements promotes fractures in the drilled material, thereby making subsequent drilling and material removal easier.

In conventional percussive drilling, the penetration mechanism is based on fracturing material at the borehole by large low-frequency uncontrolled impacts applied by the drill-bit. In this way, drilling rates for medium to hard rocks can be increased compared to standard rotary drilling. However, the downside to this is that these impacts compromise borehole stability, reduce borehole quality and cause accelerated, and often catastrophic, tool wear and/or failure.

Another important development to drilling techniques has been the application of ultrasonic axial vibrations to a rotating drill-bit. In this way, ultrasonic vibration, rather than isolated high load impacts, is used to promote fracture propagation. This can offer significant advantages over conventional percussive drilling in that lower loads can be applied, allowing for low weight-on-bit drilling. However, the improvements exhibited by ultrasonic drilling are not always consistent and are not as such directly applicable to downhole drilling.

It is therefore an object of the present invention to provide a drilling apparatus and method which seek to alleviate such problems.

According to a first aspect of the present invention there is provided drilling apparatus comprising a drill-bit capable of rotary and high frequency oscillatory loading;

control means for controlling applied rotational and/or oscillatory loading of the drill-bit, the control means having adjustment means for varying the applied rotational and/or oscillatory loading, said adjustment means being responsive to conditions of the material through which the drill is passing, wherein the control means is in use provided on the apparatus in a downhole location and includes sensors for taking downhole measurements of material characteristics, whereby the apparatus is operable downhole under closed loop real-time control.

In this way, the drilling apparatus can function autonomously and adjust the rotational and/or oscillatory loading of the drill-bit in response to the current drilling conditions so as to optimize the drilling mechanism and obtain improved drilling rates.

Preferably, the control means controls the drill-bit to impact on the material to produce a first set of macro-cracks, the control means further controlling the drill-bit to rotate and impact on the material a further occasion to produce a further set of macro-cracks, wherein the control means synchronizes the rotational and oscillatory movements of the drill-bit for promoting interconnection of the macro-cracks thus produced, to create a localized dynamic crack propagation zone ahead of the drill-bit.

Conveniently, the adjustment means controls the applied rotational and oscillatory loading of the drill-bit so as to achieve and maintain resonance between the drill-bit and the drilled material in contact therewith. Such resonance in the system comprising the drill-bit and the material being drilled minimizes the energy input required to drive the drill-bit.

In this way, crack propagation in the material ahead of the drill-bit is enhanced, making the drilling action easier and thereby increasing the drilling rate.

According to a second aspect of the present invention there is provided a drill-bit control method for use with drilling apparatus comprising a drill-bit capable of oscillatory and rotary loading and a control means for controlling applied rotational and/or oscillatory loading of the drill-bit, the control means having adjustment means for varying the applied rotational and/or oscillatory loading, said adjustment means being responsive to conditions of the material through which the drill is passing; the adjustment means further controlling the applied rotational and oscillatory loading of the drill-bit so as to achieve and maintain resonance at the drill-bit and the drilled material in contact therewith.

Preferably, the method further comprises determining appropriate loading parameters for the drill-bit according to the following steps in order to achieve and maintain resonance between the drill-bit and the drilled material in contact therewith:

A) determine a limit of amplitude of the drill-bit when resonating and interacting with the material being drilled;

B) estimate a suitable frequency sweeping range for loading the drill-bit;

C) estimate the shape of the resonance curve;

D) choose an optimum resonant frequency on the resonance curve at a point less than the maximum on the resonance curve; and E) drive the drill-bit based on this optimum resonant frequency.

In this connection, the upper limit of amplitude of the drill-bit is chosen at a value where resonance in the drill-bit will not become destructive. Beyond this limit there is a possibility that resonance will, start to have a damaging effect.

As regards estimating a suitable frequency sweeping range, this is preferably chosen so that a suitably narrow range can be evaluated and used to thereby speed up the remainder of the method.

The shape of the resonance curve is based on a basic resonance curve for the drill-bit alone, modified to take into account interactions with the material being drilled. In this regard a point is chosen on this curve at a point less than the maximum point to avoid the drill overshooting the maximum and moving into unstable/unpredictable territory.

According to a third aspect of the present invention there is provided a method of drilling through a material using a drill-bit capable of rotary and high frequency oscillatory movement, wherein the drill-bit is configured to impact on the material to produce a first set of macro-cracks, the drill-bit then rotating and impacting on the material a further occasion, to produce a further set of macro-cracks, and wherein the rotational and oscillatory movements of the drill-bit are synchronized for promoting interconnection of the macro-cracks thus produced to create a localized dynamic crack propagation zone ahead of the drill-bit.

Preferably, the method is used in the context of drilling rock formations, and the macro-cracks formed have a length of up to ten mm, preferably around 5 mm. Such a maximum length allows the extent of the crack propagation zone to be highly controlled.

Conveniently, a high frequency oscillation is applied to the drill-bit, up to 1 kHz.

Preferably, the drill-bit is driven to rotate up to 200 rpm.

Preferably, the applied rotational and oscillatory loading on the drill-bit is controlled so as to maintain resonance between the drill-bit and the drilled material in contact therewith. It will be appreciated that at such resonance conditions, less applied energy input is required to create a propagating fracture zone.

Conveniently, the propagating fracture zone extends radially outwardly no more than 1/20th of the diameter of the drill-bit from the outer edge of the drill-bit. It will be appreciated that this represents highly controlled local fracture techniques which minimize global stress in the material being drilled.

Preferably, in the context of rock formation drilling, the size of cuttings drilled are up to ten mm, preferably 5 mm. These are small in comparison with those produced by conventional drilling techniques and illustrate the step-change in methodology adopted.

Conveniently, the present method is usable in one or more of shallow gas, weak zone and fractured high pressure zone drilling applications. This arises as a result of the method of the present invention's ability to drill holes using highly controlled local fracture techniques which minimize global stress in the material being drilled.

According to a fourth aspect of the present invention there is provided a drill-bit assembly comprising:— a drill-string having a drill pipe and drill collar; and a drill-bit capable of high frequency oscillatory and rotary loading;

control means provided in use downhole for controlling applied rotational and/or oscillatory loading of the drill-bit, the control means having adjustment means for varying the applied rotational and/or oscillatory loading, said adjustment means being responsive to conditions of the material through which the drill is passing, wherein the weight of drill-string per meter is up to 70% smaller than that of a conventional drill string operating with the same borehole diameter for use in the same drilling conditions.

Conveniently, the weight of drill-string per meter is between 40 and 70% smaller than that of a conventional drill string operating with the same borehole diameter for use in the same drilling conditions.

Preferably, the weight of drill-string per meter is substantially 70% smaller than that of a conventional drill string operating with the same borehole diameter for use in the same drilling conditions.

In this way, the drilling apparatus can adjust the rotational and/or oscillatory loading of the drill-bit in response to the current drilling conditions so as to optimize the drilling mechanism and obtain improved drilling rates.

Conveniently, the adjustment means controls the applied rotational and oscillatory loading of the drill-bit so as to maintain resonance of the system comprising the drill-bit and the drilled material. The resonance phenomena enhances crack propagation in the material ahead of the drill-bit, making the drilling action easier and thereby increasing the drilling rate. In this respect, the applied rotational and oscillatory loading is based on a predicted resonance of the drilled formation.

Preferably, the drill-bit is configured to impact on the material to produce a first set of macro-cracks, the drill-bit then rotating and impacting on the material a further occasion, to produce a further set of macro-cracks, and wherein the control means synchronizes the rotational and oscillatory movements of the drill-bit for promoting interconnection of the macro-cracks thus produced to create a localized dynamic crack propagation zone ahead of the drill-bit.

Conveniently, the adjustment means determines drill-bit loading parameters for establishing resonant conditions between the drill-bit and the drilled material by the following algorithm:

A) calculating the nonlinear resonant response of, the drill-bit without the influence of the drilled material;

B) estimating the strength of impacts to produce a propagating fracture zone in the drilled material;

C) calculating the nonlinear stiffness characteristics of the fractured drilled material;

D) estimating a resonant frequency of the drill-bit interacting with the drilled material; and E) recalculating the value of the resonant frequency for a steady state by incorporating the nonlinear stiffness characteristics of the fractured drilled material.

In this respect, the applied rotational and oscillatory loading based on predicted resonance of the drilled formation.

Conveniently, the algorithm determines the unknown non linear response function.

Conveniently, the algorithm is based on a non-linear dynamic analysis, wherein dynamic interactions between the drill-bit and the drilled formation under resonant conditions are modeled by a combination of analytical and numerical techniques.

Conveniently, adjustment means updates the control means to alter the applied drilling parameters to maintain resonance of the rock formation immediately in contact with the drill-bit as it progresses.

Conveniently, the adjustment means can selectively deactivate oscillatory loading of the drill-bit for drilling through soft formations. In this way, vibrations can be deactivated when drilling through soft formations to avoid adverse effects thereby allowing the shear mode from the rotary motion to drill efficiently, and most importantly eliminating the need to swap drill-bits between hard and soft formations.

According to a further aspect of the present invention there is provided method of drilling a material comprising the steps of: applying oscillatory and rotary loading via a drill-bit; monitoring material characteristics at the material interface with the drill-bit; determining a value for the resonant frequency of the rock formation at its interface with the drill-bit; and adjusting the applied oscillatory and/or rotary loading in order to maintain the resonant frequency of the rock formation at the interface with the drill-bit.

Conveniently, said method further comprises the step of applying an algorithm from a non-linear dynamic analysis for determining the resonant frequency of the material at its interface with the drill-bit.

Conveniently, the algorithm has the following functions:

A) calculating the nonlinear resonant response of the drill-bit without the influence of the drilled material;

B) estimating the strength of impacts to produce a propagating fracture zone in the drilled material;

C) calculating the nonlinear stiffness characteristics of the fractured drilled material;

D) estimating a resonant frequency of the drill-bit interacting with the drilled material; and E) recalculating the value of the resonant frequency for a steady state by incorporating the nonlinear stiffness characteristics of the fractured drilled material.

An example of the present invention will now be described with reference to the accompanying drawings in which:—

Figure 2:
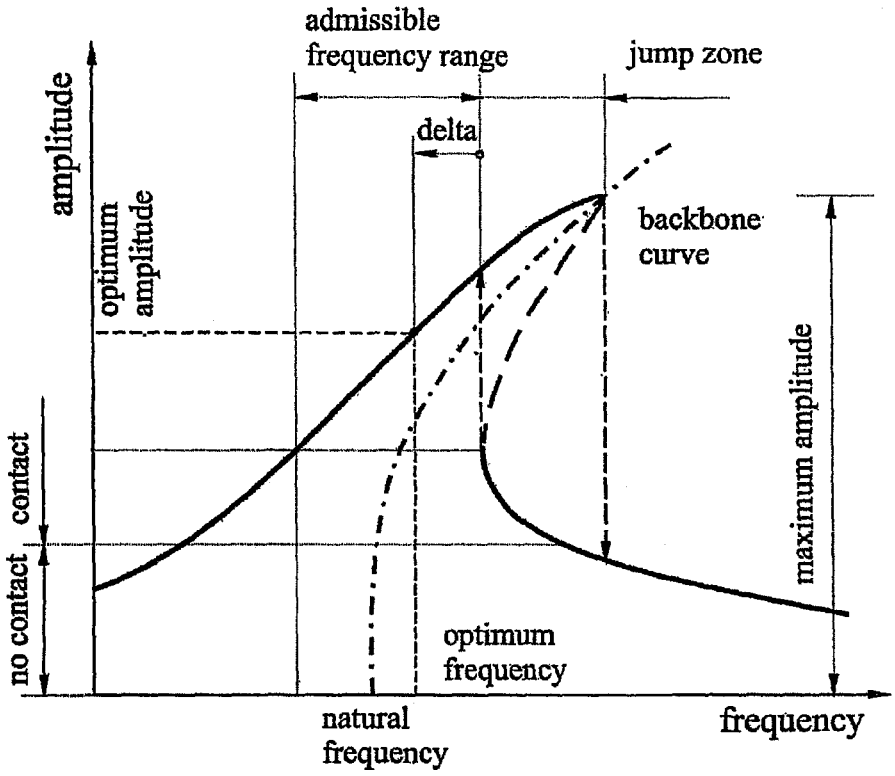

FIG. 1 shows a drilling module according to an embodiment of the present invention; and FIG. 2 illustrates graphically how parameters for establishing resonant conditions in accordance with the present invention are found.

In the development of the present invention, it was realized that particularly high drilling rates could be achieved when drilling through materials such as rock formations if the loading of the drill-bit is set to promote resonance is the system formed by the drill-bit and the drilled formation.

However, whilst obtaining this resonance is possible on a test rig using standardized samples, it was a different matter when drilling through natural rock formations. This is because drilling conditions vary from layer to layer within a formation. Accordingly, the resonant conditions vary throughout the formation and therefore resonant conditions cannot be maintained throughout the drilling process.

The present invention overcomes this problem by recognizing the non-linear resonance phenomenon when drilling through a material and seeks to maintain resonance in the system combination of the drill-bit and drilled material.

In order to achieve this the applicants have, by accurately identifying the parameters and mechanisms affecting drilling, developed an accurate and robust mathematical model of the dynamic interactions in the borehole. This mathematical model allows the present invention to calculate and use feedback mechanisms to automatically adjust the drilling parameters so as to maintain resonance at the borehole site. By maintaining the resonance in this way, the action of the propagating crack zone ahead of the drill-bit is enhanced and the drilling rate is greatly improved, and therefore can be described as Resonance Enhanced Drilling (hereinafter RED).

FIG. 1 shows an illustrative example of a RED drilling module according to an embodiment of the present invention. The drilling module is equipped with a polycrystalline diamond (PCD) drill-bit 1. A vibro-transmission section 2 connects the drill-bit 1 with a piezoelectric transducer 3 to transmit vibrations from the transducer to the drill-bit 1. A coupling 4 connects the module to a drill-string 5 and acts as a vibration isolation unit to isolate vibrations of the drilling module from the shaft.

During a drilling operation, a DC motor rotates the drill shaft, which transmits the motion through sections 4, 3 and to the drill-bit 1. A relatively low static force applied to the drill-bit 1 together with the dynamic loading generate the propagating fracture zone, so that the drill-bit progresses through the material.

At the same time as the rotation of the drilling module 1, the piezoelectric transducer 3 is activated to vibrate at a frequency appropriate for the material at the borehole site. This frequency is determined by calculating the non-linear resonant conditions between the drill-bit and the drilled material, schematically shown in FIG. 2, according to the following algorithm:

A) calculating the nonlinear resonant response of the drill-bit without the influence of the drilled material;

B) estimating the strength of impacts to produce a propagating fracture zone in the drilled material;

C) calculating the nonlinear stiffness characteristics of the fractured drilled material;

D) estimating a resonant frequency of the drill-bit interacting with the drilled material; and E) recalculating the value of the resonant frequency for a steady state by incorporating the nonlinear stiffness characteristics of the fractured drilled material.

The vibrations from the piezoelectric transducer 3 are transmitted through the drill-bit 1 to the borehole site and create a propagating crack zone in the material ahead of the drill-bit. As the drill-bit continues to rotate and move forward, it shears against the material in the formation, cutting into it. However, the creation of a propagating crack zone in the formation material ahead of the drill-bit significantly weakens it, meaning that the rotating shearing action dislodges more material, which can subsequently be removed.

The properties of the crack propagation dynamics can be tuned to optimize for ROP, hole quality and tool life, or ideally a combination of all three.

Cracks are started as a result of inserts in the drill-bit impacting on the formation. Other drilling techniques operate through shaving or shearing the rock or through the generation of much larger cracks. The following are the main features of the RED system in terms of means of operation and focus on the creation and propagation of 'macro' cracks in the immediate vicinity ahead of the drill-bit.

RED operates through a high frequency axial oscillation of a drilling head which impacts the material and the angular geometry of the drill-bit inserts initiate cracks in the material. Continued operation of the drilling bit, i.e continued oscillation and rotation, establishes a dynamic crack propagation zone ahead of the drill-bit.

This phenomenon may be best described as synchronized kinematics. Establishment of resonance in the system (system comprising the drilled material, (the oscillator) and the drill-bit) optimizes the efficiency and performance. The dynamic crack propagation zone is local to the drill-bit and a linear dimension typically measures no more than 1/10th of the diameter of the drill-bit.

Hence local crack propagation is controllable in terms of its directionality and the RED technique avoids crack propagation outside the zone immediately in front of the drill-bit.

RED hence can result in high quality true gauge hole.

As a result of, the 'sensitivity' of the RED technique, its ability to drill holes using highly controlled local fracture and minimizing global stress in the formation, the RED technique will lend itself very well to drilling sensitive formations in challenging areas such as shallow gas; weak zones; and fractured high pressure zones.

According to the above, the present invention can maintain resonance throughout the drilling operation, allowing material to be dislodged from the formation at the borehole site more quickly, and consequently higher drilling rates are achieved. Furthermore, the utilization of resonance motion to promote fracture propagation allows lower weight to be applied to the drill-bit leading to decreased tool wear. As such, the present invention not only offers an increased rate of penetration (ROP) but also allows for increased tool life-span, and hence reduces the downtime required for tool maintenance or replacement.

Once drilled material mechanical properties are known, the drilling parameters can be modified to optimize performance of the drilling (according to ROP, hole Quality and tool life and reliability).

In terms of the RED technique, frequency and amplitude of oscillations can be modified to establish the most efficient and effective performance. The establishment of oscillation system resonance (between the (oscillator), the drill-bit and the drilled formation) provides the optimum combination of energy efficiency and drilling performance.

FIG. 2 graphically illustrates how the parameters for establishing and maintaining resonant conditions are found.

Firstly, one needs to determine a limit of amplitude of the drill-bit when resonating and interacting with the material being drilled. In this connection, the limit of amplitude of the drill-bit is chosen at a value where resonance in the drill-bit will not become destructive. Beyond this limit there is a possibility that resonance will start to have a damaging effect.

Then, a suitable frequency sweeping range for loading the drill-bit is estimated. This is estimated so that a suitably narrow range can be evaluated which can then used to speed up the remainder of the method.

The shape of the resonance curve is then estimated. As can be seen, this is a typical resonance curve whose top has been pushed over to the right as a consequence of the effect of the drill-bit interacting with a material being drilled. It will be noted that as a consequence the graph has upper and lower branches, the consequence of moving on the curve beyond the maximum amplitude being a dramatic drop in amplitude from the upper branch to the lower branch.

As such, in order to avoid such dramatic changes, which are undesirable, the next step is to choose an optimum frequency on the resonance curve at a point less than the maximum on the resonance curve. The extent to which the optimum resonant frequency is chosen below the maximum essentially sets a safety factor and for changeable/variable drilling materials, this may be chosen further from the maximum amplitude point. The control means may in this regard alter the safety factor, i.e. move away from or towards the maximum point on the resonance curve, depending on the sensed characteristics of the material being drilled or progress of the drill. For example, if the ROP is changing irregularly due to low uniformity of material being drilled, then the safety factor may be increased.

Finally, the apparatus is driven at the chosen optimum resonant frequency, and the process is updated periodically within the closed loop operating system of the control means.

With the present invention, the weight of drill-string per meter can be up to 70% smaller than that of a conventional drill string operating with the same borehole diameter for use in the same drilling conditions. Preferably it is in the range 40-70% smaller, or more preferably it is substantially 70% smaller.

For example, under typical drilling conditions and a drilling depth of 12,500 ft (3787 m), for a 12¼" (0.31 m) hole size, the drill-string weight per meter is reduced from 38.4 kg/m (Standard Rotary Drilling) to 11.7 kg/m (using RED technique)—a reduction of 69.6%.

Under typical drilling conditions and a drilling depth of 12,500 ft (3787 m), for a 17½" (0.44 m) hole size, the drill-string weight per meter is reduced from 49.0 kg/m (Standard Rotary Drilling) to 14.7 kg/m (using RED technique)—a reduction of 70%.

Under typical drilling conditions and a drilling depth of 12,500 ft (3787 m), for a 26" (0.66 m) hole size the drill-string weight per meter is reduced from 77.0 kg/m (Standard Rotary Drilling) to 23.1 kg/m (using RED technique)—a reduction of 70%.

As a result of the low WOB and the dynamic fracture it produces, the RED technique can save up to 35% of energy cost on the rig and 75% of drill collar weight savings.

It will be understood that the illustrated embodiment described herein shows an application of the invention only for the purposes of illustration. In practice the invention may be applied to many different configurations; the detailed embodiments being straightforward to those skilled in the art to implement.

For example, the drill-bit section of the module may be modified as appropriate to the particular drilling application. For instance, different drill-bit geometries and materials may be used.

In another example, other vibration means may be used as alternative to the piezoelectric transducer for vibrating the drilling module. For example, a magnetostrictive material may be used.

Furthermore, it is also envisaged that the vibration means may be deactivated when drilling through soft formations to avoid adverse effects. For example, the drilling module of the present invention may be deactivated so as to function as a rotary (only) drilling module when first drilling through an upper soft soil formation. The drilling module can then be activated to apply resonant frequencies once deeper hard rock formations are reached. This offers considerable time savings by eliminating the downtime which would otherwise be necessary to swap drilling modules between these different formations.

The present invention provides the following benefits, namely drilling having lower energy inputs, improved rate of penetration (ROP), improved hole stability and quality and improved tool life and reliability.

The invention claimed is:

1. A drilling module comprising:

a rotary drill-bit;

an oscillator configured to apply high frequency axial oscillatory loading to the rotary drill-bit, of up to 1 kHz;

a vibro-transmission section connecting the rotary drill-bit and the oscillator, the vibro-transmission section configured to transmit the high frequency axial oscillatory loading from the oscillator to the rotary drill-bit;

a vibrational isolation unit for connecting the drilling module to a drill-string, the vibrational isolation unit being configured to isolate the high frequency axial oscillatory loading from the drill-string;

sensors for taking downhole measurements; and a controller configured to operate downhole under closed loop real-time control by utilizing the downhole measurements from the sensors to control the oscillator by varying the high frequency axial oscillatory loading responsive to conditions of material through which the rotary drill-bit is passing to establish and maintain oscillation system resonance between the oscillator, the rotary drill-bit and the material through which the rotary drill-bit is passing whereby the high frequency axial oscillatory loading is sufficient to initiate cracks in the material through which the rotary drill-bit is passing.

2. A drilling module according to claim 1, wherein the controller is configured to sweep a frequency range to evaluate conditions of the material through which the rotary drill-bit is passing to establish and maintain oscillation system resonance.

3. A drilling module according to claim 1, wherein the oscillator is configured to apply high frequency axial oscillatory loading based on a basic resonance curve for the rotary drill-bit and modify the high frequency axial oscillatory loading to take into account interactions with the material being drilled.

4. A drilling module according to claim 1, wherein the controller is configured to determining appropriate loading parameters for the rotary drill-bit according to the following steps in order to achieve and maintain oscillation system resonance:

A) determine a limit of amplitude of the rotary drill-bit when resonating and interacting with the material being drilled;

B) estimate a suitable frequency sweeping range for loading the drill-bit;

C) estimate the shape of a resonance curve;

D) choose an optimum resonant frequency on the resonance curve at a point less than the maximum on the resonance curve; and E) drive the rotary drill-bit based on this optimum resonant frequency.

5. A drilling module according to claim 1, wherein the controller is configured to autonomously adjust rotational and high frequency axial oscillatory loading of the rotary drill-bit in response to current drilling conditions.

6. A drilling module according to claim 5, wherein the controller is configured to control the rotary drill-bit to impact on the material through which the rotary drill bit is passing to produce a first set of macro-cracks, the controller being further configured to control the rotary drill-bit to rotate and impact on the material a further occasion to produce a further set of macro-cracks, the controller being configured to synchronize rotational and oscillatory movements of the rotary drill-bit for promoting interconnection of the macro-cracks thus produced, to create a localized dynamic crack propagation zone ahead of the rotary drill-bit.

7. A method for controlling a resonance enhanced rotary drill comprising a rotary drill-bit and an oscillator for applying high frequency axial oscillatory loading to the rotary drill-bit of up to 1 kHz, the method comprising:

applying high frequency axial oscillatory loading to the rotary drill-bit;

taking downhole measurements;

controlling the applied high frequency axial oscillatory loading downhole under closed loop real-time control by utilizing the downhole measurements to vary the high frequency axial oscillatory loading responsive to conditions of material through which the rotary drill-bit is passing to establish and maintain oscillation system resonance between the oscillator, the rotary drill-bit and the material through which the rotary drill-bit is passing whereby the high frequency axial oscillatory loading is sufficient to initiate cracks in the material through which the rotary drill-bit is passing.

8. A method according to claim 7, further comprising:

sweeping a frequency range to evaluate conditions of the material through which the rotary drill-bit is passing to establish and maintain oscillation system resonance.

9. A method according to claim 7, wherein the high frequency axial oscillatory loading is applied based on a basic resonance curve for the rotary drill-bit and the high frequency axial oscillatory loading is modified to take into account interactions with the material being drilled.

10. A method according to claim 7, further comprising determining appropriate loading parameters for the rotary drill-bit according to the following steps in order to achieve and maintain oscillation system resonance:

A) determine a limit of amplitude of the rotary drill-bit when resonating and interacting with the material being drilled;

B) estimate a suitable frequency sweeping range for loading the drill-bit;

C) estimate the shape of a resonance curve;

D) choose an optimum resonant frequency on the resonance curve at a point less than the maximum on the resonance curve; and E) drive the rotary drill-bit based on this optimum resonant frequency.

11. A method according to claim 7, wherein the rotational and high frequency axial oscillatory loading of the rotary drill-bit are adjust autonomously in response to current drilling conditions.

12. A method according to claim 11, wherein the rotary drill-bit is controlled to impact on the material through which the rotary drill bit is passing to produce a first set of macro-cracks, and to rotate and impact on the material a further occasion to produce a further set of macro-cracks, the rotational and oscillatory movements of the rotary drill-bit being synchronized to promote interconnection of the macro-cracks thus produced, to create a localized dynamic crack propagation zone ahead of the rotary drill-bit.

13. A control apparatus configured to perform the method of claim 7 when mounted in a drilling module comprising a rotary drill-bit;

an oscillator configured to apply high frequency axial oscillatory loading to the rotary drill-bit, of up to 1 kHz;

a vibro-transmission section connecting the rotary drill-bit and the oscillator, the vibro-transmission section configured to transmit the high frequency axial oscillatory loading from the oscillator to the rotary drill-bit;

a vibrational isolation unit for connecting the drilling module to a drill-string, the vibrational isolation unit being configured to isolate the high frequency axial oscillatory loading from the drill-string;

sensors for taking downhole measurements; and a controller configured to operate downhole under closed loop real-time control by utilizing the downhole measurements from the sensors to control the oscillator by varying the high frequency axial oscillatory loading responsive to conditions of material through which the rotary drill-bit is passing to establish and maintain oscillation system resonance between the oscillator, the rotary drill-bit and the material through which the rotary drill-bit is passing whereby the high frequency axial oscillatory loading is sufficient to initiate cracks in the material through which the rotary drill-bit is passing.

* * * * *